US012575630B2

(12) United States Patent
Kele et al.

(10) Patent No.: US 12,575,630 B2
(45) **Date of Patent: *Mar. 17, 2026**

(54) CYCLING HELMET WITH ROTATIONAL IMPACT ATTENUATION

(71) Applicant: Bell Sports, Inc., Scotts Valley, CA (US)

(72) Inventors: Paul A. Kele, Soquel, CA (US); David T. Debus, Felton, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/909,253

(22) Filed: Oct. 8, 2024

(65) Prior Publication Data

US 2025/0024906 A1 Jan. 23, 2025

Related U.S. Application Data

(63) Continuation of application No. 17/723,380, filed on Apr. 18, 2022, now Pat. No. 12,137,765, which is a continuation of application No. 16/420,562, filed on May 23, 2019, now Pat. No. 11,304,470.

(60) Provisional application No. 62/833,935, filed on Apr. 15, 2019, provisional application No. 62/686,425, filed on Jun. 18, 2018.

(51) Int. Cl.

| | |
|---|---|
| ***A42B 3/06*** | (2006.01) |
| ***A42B 3/08*** | (2006.01) |
| ***A42B 3/12*** | (2006.01) |
| ***A42B 3/32*** | (2006.01) |

(52) U.S. Cl.

CPC ..... *A42B 3/066* (2013.01); *A42B 3/064* (2013.01); *A42B 3/324* (2013.01); *A42B 3/08* (2013.01)

(58) Field of Classification Search

CPC ..... A42B 3/064; A42B 3/066; A42B 3/063; A42B 3/12; A42B 3/128; A42B 3/125; A42B 3/127; A42B 3/06; A42B 3/062; A42B 3/08; A42B 3/10; A42B 3/324

See application file for complete search history.

(56) References Cited

U.S. PATENT DOCUMENTS

| | | | |
|---|---|---|---|
| 3,153,242 | A | 10/1964 | Nedwick |
| 4,012,794 | A | 3/1977 | Nomiyama |

(Continued)

FOREIGN PATENT DOCUMENTS

| | | | |
|---|---|---|---|
| EP | 0790787 | B1 | 9/2000 |
| EP | 2734071 | B1 | 6/2017 |

(Continued)

OTHER PUBLICATIONS

IPRP for PCT application PCT/US2012/047662, dated Jan. 21, 2014.

EP Search Opinion for EP2734071, dated Mar. 30, 2015.

*Primary Examiner* — Amy Vanatta

(74) *Attorney, Agent, or Firm* — Reed Smith LLP; Walter M. Egbert, III; Richard J. Brown

(57) ABSTRACT

A helmet having an outer liner with an inward-facing surface, an inner liner with an outward-facing surface that interfaces with the inward-facing surface of the outer liner, and a flexible tether coupling the outer liner to the inner. The inner liner is slidably coupled to the outer liner via a plurality of return springs, the plurality of return springs biasing the inner liner to a first position with respect to the outer liner.

20 Claims, 14 Drawing Sheets

(56) References Cited

U.S. PATENT DOCUMENTS

| | | | | |
|---|---|---|---|---|
| 6,658,671 | B1 | 12/2003 | von Holst et al. | |
| 8,863,319 | B2 | 10/2014 | Knight | |
| 8,955,169 | B2 | 2/2015 | Weber et al. | |
| 9,060,561 | B2 | 6/2015 | Knight | |
| 9,271,536 | B2 | 3/2016 | Knight | |
| 9,414,635 | B2 | 8/2016 | Knight | |
| 9,516,909 | B2 | 12/2016 | Knight | |
| 2001/0032351 | A1 | 10/2001 | Nakayama et al. | |
| 2002/0023291 | A1 | 2/2002 | Mendoza | |
| 2004/0250340 | A1 | 12/2004 | Piper et al. | |
| 2010/0115686 | A1 | 5/2010 | Halldin | |
| 2013/0042397 | A1 | 2/2013 | Halldin | |
| 2013/0185837 | A1 | 7/2013 | Phipps et al. | |
| 2013/0232668 | A1 | 9/2013 | Suddaby | |
| 2015/0143617 | A1 | 5/2015 | Suddaby | |
| 2015/0157083 | A1 | 6/2015 | Lowe | |
| 2015/0223547 | A1 | 8/2015 | Wibby | |
| 2015/0250248 | A1 | 9/2015 | Jacobsen | |
| 2016/0029730 | A1* | 2/2016 | Day | A42B 3/064 2/412 |
| 2016/0262483 | A1* | 9/2016 | Cheng | A42B 3/0406 |
| 2016/0316847 | A1* | 11/2016 | Weber | A42B 3/064 |
| 2017/0105470 | A1 | 4/2017 | Eaton | |
| 2017/0112220 | A1 | 4/2017 | Suddaby | |
| 2017/0172242 | A1 | 6/2017 | Leatt et al. | |
| 2017/0290388 | A1 | 10/2017 | Briggs | |
| 2018/0000186 | A1 | 1/2018 | Brown | |
| 2018/0153243 | A1 | 6/2018 | Pradeep | |
| 2018/0160760 | A1 | 6/2018 | Suddaby | |
| 2018/0228239 | A1* | 8/2018 | Day | F16F 1/126 |
| 2018/0271198 | A1 | 9/2018 | Ku | |
| 2019/0000174 | A1* | 1/2019 | Shaffer | A42B 3/283 |
| 2019/0133233 | A1 | 5/2019 | Locatelli | |
| 2019/0159540 | A1 | 5/2019 | Pradeep | |
| 2019/0350295 | A1 | 11/2019 | Timlick | |
| 2020/0037690 | A1 | 2/2020 | Pomering | |
| 2020/0121015 | A1 | 4/2020 | Ku | |
| 2020/0305534 | A1 | 10/2020 | Chilson | |
| 2020/0305536 | A1 | 10/2020 | Kele | |
| 2021/0007435 | A1* | 1/2021 | Pietrzak | A42B 3/125 |

FOREIGN PATENT DOCUMENTS

| | | | |
|---|---|---|---|
| WO | 9321789 | A1 | 11/1993 |
| WO | WO1996/014768 | A1 | 5/1996 |
| WO | WO2013/013180 | A1 | 1/2013 |
| WO | 2020242373 | A1 | 12/2020 |

* cited by examiner

CYCLING HELMET WITH ROTATIONAL IMPACT ATTENUATION

RELATED APPLICATIONS

This application is continuation of U.S. Nonprovisional patent application Ser. No. 17/723,380, filed Apr. 18, 2022; which is a continuation of U.S. Nonprovisional patent application Ser. No. 16/420,562, filed May 23, 2019, now U.S. Pat. No. 11,304,470, issued Apr. 19, 2022, which claims the benefit of U.S. Provisional Patent Application No. 62/686,425, filed Jun. 18, 2018 and U.S. Provisional Patent Application No. 62/833,935, filed Apr. 15, 2019, the disclosures of which are hereby incorporated by reference in their entirety.

TECHNICAL FIELD

Aspects of this document relate generally to helmets with rotational impact attenuation.

BACKGROUND

Protective headgear and helmets have been used in a wide variety of applications and across a number of industries including sports, athletics, construction, mining, military defense, and others, to protect against damage to a user's head and brain. Contact injury to a user can be prevented or reduced by helmets that restrict hard objects or sharp objects from directly contacting the user's head. Non-contact injuries, such as brain injuries caused by linear or rotational accelerations of a user's head, can also be prevented or reduced by helmets that absorb, distribute, or otherwise manage energy of an impact. This may be accomplished using multiple layers of energy management material.

Some conventional helmets employ structures or objects that bridge energy management liners that must break, deform, and/or strain an elastic material for the liners to rotate against each other. Such a method of energy absorption has advantages and disadvantages; while the energy is absorbed by the failure or deformation of the projections, the liners may tend to rotate out of one another, reducing the helmet stability. In addition, depending on the location of an impact on the helmet, one or more liners may be completely removed from the user's head, drastically reducing the effectiveness of the helmet in protecting against subsequent impacts that occur in that incident.

Additionally, many bicycle helmets have lettering on them to communicate the brand of the helmet or the company that made it. This lettering is typically attached to the helmet letter by letter with some form of adhesive. Once the adhesive fails or an object hits the lettering at the right angle, the lettering may easily fall off and often does not remain in place. Not only does this compromise the branding of the helmet, such failures may provide a starting point for additional faults in the outermost shell of the helmet, potentially reducing its effectiveness in protecting the wearer.

SUMMARY

An aspect of the disclosure relates to a helmet comprising an outer liner formed of a first foamed energy management material and comprising an inward-facing surface, an inner liner formed of a second foamed energy management material and positioned at least partially inside the outer liner, the inner liner comprising an outward-facing surface facing the inward-facing surface of the outer liner, at least one chin strap anchored to the outer liner and passing through an opening in the inner liner, a plurality of return springs each comprising an elastomeric material, each return spring having a first end coupled to the inward-facing surface of the outer liner, a second end distal to the first end and coupled to the outward-facing surface of the inner liner, and a body connecting the first end and the second end, the plurality of return springs biasing the inner liner to a first position with respect to the outer liner, and at least one leash coupling, each leash coupling comprising an upper end coupled to the outer liner, a lower end distal to the upper end and coupled to the inner liner, and a flexible tether that connects the upper end and the lower end, and passes through the inward-facing surface of the outer liner and the outward-facing surface of the inner liner, wherein the inner liner is slidably coupled to the inward-facing surface of the outer liner through the plurality of return springs and slidably movable relative to the outer liner between the first position and a second position where the inner liner and outer liner are rotated with respect to each other away from the first position, wherein both the inward-facing surface of the outer liner and the outward-facing surface of the inner liner are substantially parallel to a portion of a sphere, wherein the body of each of the plurality of return springs is substantially tangential to the sphere, and wherein, for each of the at least one leash coupling, a majority of the tether is located in a cavity formed in at least one of the outer liner and inner liner.

Particular embodiments may comprise one or more of the following features. At least one glide pad having an adhesive surface affixed to one of the inward-facing surface of the outer liner and the outward-facing surface of the inner liner, and a glide surface opposite the adhesive surface, the glide surface having a coefficient of friction lower than the coefficient of friction of the one of the inward-facing surface of the outer liner and the outward-facing surface of the inner liner. At least one of the inward-facing surface of the outer liner and the outward-facing surface of the inner liner may comprise an annealed surface. The first foamed energy management material and the second foamed energy management material may each comprise one of expanded polystyrene and expanded polypropylene.

An aspect of the disclosure relates to a helmet comprising an outer liner comprising an inward-facing surface, an inner liner positioned at least partially inside the outer liner, the inner liner comprising an outward-facing surface facing the inward-facing surface of the outer liner, a plurality of return springs comprising an elastomeric material, each return spring having a first end coupled to the inward-facing surface of the outer liner, a second end distal to the first end and coupled to the outward-facing surface of the inner liner, and a body connecting the first end and the second end, the plurality of return springs biasing the inner liner to a first position with respect to the outer liner, and at least one chin strap anchored to the outer liner and passing through an opening in the inner liner, wherein the inner liner is slidably coupled to the inward-facing surface of the outer liner through the plurality of return springs and slidably movable relative to the outer liner between the first position and a second position where the inner liner and outer liner are rotated with respect to each other away from the first position, and wherein the body of each return spring of the plurality of return springs is substantially tangential to at least one of the inward-facing surface of the outer liner and the outward-facing surface of the inner liner.

Particular embodiments may comprise one or more of the following features. The outer liner may be formed of a first foamed energy management material and the inner liner is formed of a second foamed energy management material. Both the inward-facing surface of the outer liner and the outward-facing surface of the inner liner may be substantially parallel to a portion of a sphere. For each return spring of the plurality of return springs, at least one of the first end and the second end may sit in a recess in one of the inward-facing surface of the outer liner and the outward-facing surface of the inner liner, the recess having a depth at least equal to a thickness of the return spring. For at least one of the plurality of return springs, one of the first end and the second end may be coupled to one of the inward-facing surface of the outer liner and the outward-facing surface of the inner liner by a fastener passing through the return spring and into the one of the inward-facing surface of the outer liner and the outward-facing surface of the inner liner. Each fastener may be locked inside a different receiver, each receiver being embedded in one of the outer liner and the inner liner. For at least one of the plurality of return springs, one of the first end and the second end may be in-molded into one of the inner liner and the outer liner. An outer shell disposed on an outward-facing surface of the outer liner opposite the inward-facing surface of the outer liner, the outer shell comprising a shaped aperture. A branding element comprising a first portion passing through the shaped aperture of the outer shell, and a second portion disposed between the outer shell and the outward-facing surface of the outer liner. At least one leash coupling, each leash coupling comprising an upper end coupled to the outer liner, a lower end distal to the upper end and coupled to the inner liner, and a tether that is flexible, connects the upper end and the lower end, and passes through the inward-facing surface of the outer liner and the outward-facing surface of the inner liner, wherein, for each of the at least one leash coupling, a majority of the tether is located in a cavity formed in at least one of the outer liner and inner liner. For each of the at least one leash coupling, the tether may be between 10 mm and 15 mm long. For each of the at least one leash coupling, the upper end may comprise an upper anchor coupled to an upper snap receptacle in-molded into the outer liner, and the lower end may comprise a lower anchor coupled to a lower snap receptacle in-molded into the inner liner. The tether of each leash coupling may be composed of nylon. At least one of the upper end and the lower end of each leash coupling may be in-molded into at least one of the outer liner and the inner liner.

According to an aspect of the disclosure, a method of assembling a helmet that includes an inner liner and an outer liner comprises providing the outer liner of the helmet, the outer liner having an inward-facing surface, coupling a plurality of return springs to the outer liner by affixing a first end of each return spring to the outer liner, each return spring comprising an elastomeric material and further comprising a second end distal to the first end and having a different one of a plurality of fasteners, coupling at least one chin strap to the outer liner, providing the inner liner of the helmet, the inner liner having an outward-facing surface, positioning the inner liner at least partially inside the outer liner, the inward-facing surface of the outer liner facing the outward-facing surface of the inner liner, threading the at least one chin strap through an opening in the inner liner, and coupling the inner liner to the outer liner by pressing the inner liner into the outer liner until the plurality of fasteners are passing through the outward-facing surface of the inner liner, thereby coupling the outward-facing surface to the inward-facing surface through the plurality of return springs.

Particular embodiments may comprise one or more of the following. Annealing at least a portion of at least one of the outward-facing surface of the inner liner and the inward-facing surface of the outer liner. Cutting a shaped aperture in an outer shell, the outer shell having an inward-facing surface and an outward-facing surface, providing a branding element, applying an adhesive to one of the inward-facing surface of the outer shell proximate the shaped aperture and a branding element, inserting a first portion of the branding element through the shaped aperture, and forming the outer liner inside the outer shell, trapping a second portion of the branding element between the inward-facing surface of the outer shell and the outward-facing surface of the outer liner while the first portion of the branding element passes through the shaped aperture to extend outward from the outward-facing surface of the outer shell, the outer liner formed of a first foamed energy management material.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1A:
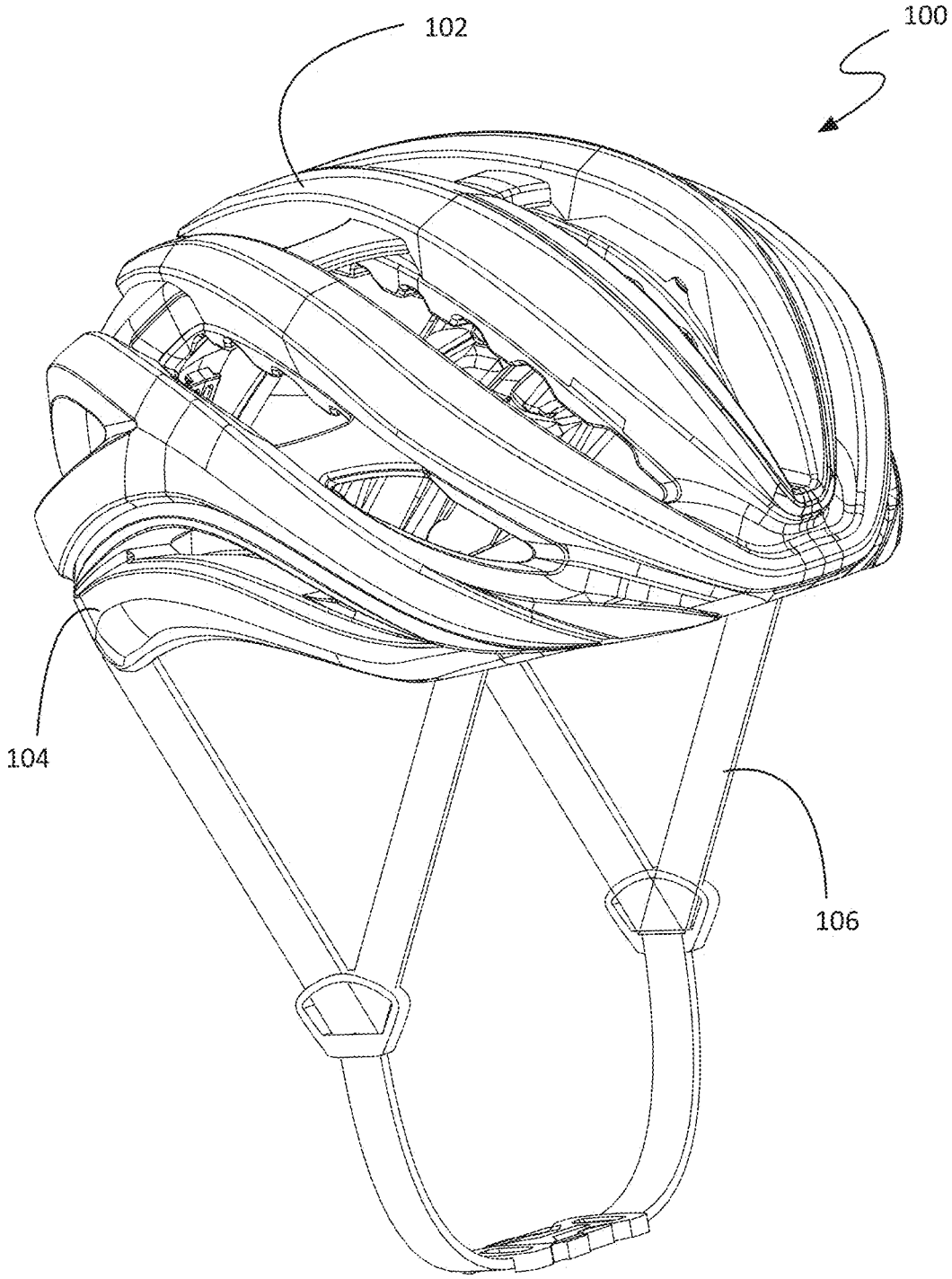
FIG. 1A is a perspective view of a helmet with an inner liner and an outer liner.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Protective headgear and helmets have been used in a wide variety of applications and across a number of industries including sports, athletics, construction, mining, military defense, and others, to reduce the risk of damage to a user's head and brain. Contact injury to a user can be prevented or reduced by helmets that restrict hard objects or sharp objects from directly contacting the user's head. Non-contact injuries, such as brain injuries caused by linear or rotational accelerations of a user's head, can also be prevented or reduced by helmets that absorb, distribute, or otherwise manage energy of an impact. This may be accomplished using multiple layers of energy management material.

Some conventional helmets employ structures or objects that bridge energy management liners that must break, deform, and/or strain an elastic material for the liners to rotate against each other. Such a method of energy absorption has advantages and disadvantages; while the energy is absorbed by the failure or deformation of the projections, the liners may tend to rotate out of one another, reducing the helmet stability. In addition, depending on the location of an impact on the helmet, one or more liners may be completely removed from the user's head, drastically reducing the effectiveness of the helmet in protecting against subsequent impacts that occur in that incident.

Additionally, many bicycle helmets have lettering on them to communicate the brand of the helmet or the company that made it. This lettering is typically attached to the helmet letter by letter with some form of adhesive. Once the adhesive fails or an object hits the lettering at the right angle, the lettering may easily fall off and often does not remain in place. Not only does this compromise the branding of the helmet, such failures may provide a starting point for additional faults in the outermost shell of the helmet, potentially reducing its effectiveness in protecting the wearer.

Contemplated herein is a cycling helmet with rotational impact attenuation. Various embodiments of this helmet comprise an inner liner positioned at least partially inside of an outer liner and able to rotate with respect to the outer liner along their interfacing surfaces. The liners are coupled to each other through a plurality of elastomeric return springs that attenuate the rotation. Additionally, the liners may be further coupled to each other through one or more chin straps that are affixed to the outer liner and pass through the inner liner. Furthermore, the liners may also be coupled to each other through one or more leash couplings that impose an upper limit to the motion of the liners relative to each other. Such a configuration is advantageous over conventional helmets, as it allows for the attenuation of rotational energy due to a helmet impact while reducing the risk of the complete separation of the two liners.

Furthermore, contemplated herein is a method for affixing a branding element to a helmet such that it is part of the helmet rather than affixed to the outermost shell. According to various embodiments, a branding element may be coupled to a helmet such that a first portion of the branding element extends through the outer shell of a helmet while a second portion is trapped between the outer shell and the outer liner, providing greater mechanical stability without drastically modifying or complicating the manufacturing process.

Figure 1B:
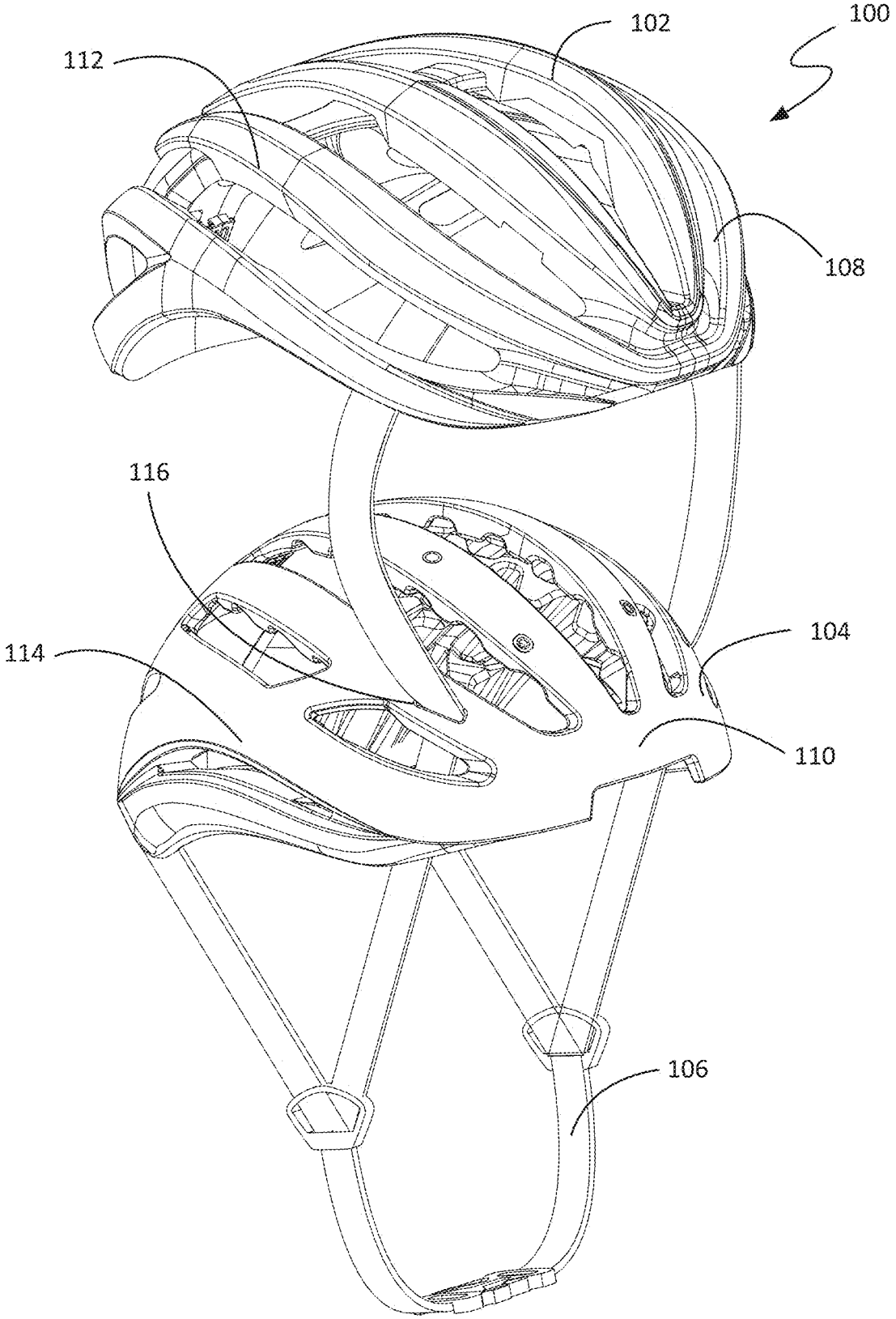
FIG. 1B is an exploded view of the helmet of FIG. 1.

FIGS. 1A and 1B are perspective views of a non-limiting example of a helmet providing stable rotational energy attenuation, according to various embodiments. Specifically, FIG. 1A is an assembled view, and FIG. 1B is an exploded view. As shown, the helmet 100 comprises an outer liner 102, and inner liner 104, and at least one chin strap 106. The following discussion will be done in the context of a helmet 100 having two liners (outer 102 and inner 104). However, it should be noted that this context is exemplary only, and that the structures and methods contemplated herein may be adapted for helmets having more than two energy management liners.

The inner liner 104 is positioned at least partially inside the outer liner 102. As shown, the inner liner 104 comprises an outward-facing surface 114, and the outer liner 102 comprises an outward-facing surface 112. An inward-facing surface 300 of the outer liner 102 will be discussed in the context of FIG. 3, below. In the context of the present description and the claims that follow, "outward-facing" means facing away from the head of the wearer, while "inward-facing" means facing towards the head of the wearer, while the helmet is in use.

According to various embodiments, the outer liner 102 and inner liner 104 comprise energy management material, to provide protection against impacts. Specifically, in some embodiments, the outer liner 102 is formed of a first foamed energy management material 108, and the inner liner 104 is formed of a second foamed energy management material 110. In some embodiments, the first 108 and second 110 foamed energy management materials may be the same material, while in others they are different. As used herein, the foamed energy management material may comprise any foamed energy management material known in the art of protective helmets, such as but not limited to expanded polystyrene (EPS), expanded polyurethane (EPU), expanded polyolefin (EPO), expanded polypropylene (EPP), or other suitable material.

As shown, the helmet 100 further comprises at least one chin strap 106. In the context of the present description and the claims that follow, a chin strap refers to a flexible or semi-flexible strap that, in some way, secures the helmet to the wearers head, as is known in the art. According to various embodiments, the chin strap(s) 106 is anchored to the outer liner 102, and passes through an opening 116 in the inner liner 104 such that it enters the interior space of the helmet 100 where the wearers head is located, allowing it to be secured around the wearers head comfortably. It should be noted that in FIG. 1B, the lengths of the chin straps 106 have been exaggerated, to better illustrate how they pass through openings 116 in the inner liner 104.

In the context of the present description and the claims that follow, to "anchor" a chin strap 106 to the outer liner 102 means to couple the chin strap 106 to the outer liner 102 in such as way that it cannot be pulled inward (or the helmet 100 lifted off the wearers head) without a drastic mechanical failure of either the helmet 100 or the strap 106. In some embodiments, an end of the chin strap 106 may be in-molded within the outer liner 102, as is known in the art. As an option, the strap 106 may be coupled to another object before in-molding, to increase it's surface area and create a stronger coupling with the outer liner 102. In other embodiments, the strap 106 may be secured outside of the outer liner 102, such that it cannot be pulled back through (e.g. attached to a wide, flat structure sitting flush with the outer surface of the outer liner 102, etc.). Other methods known in the art for affixing a strap to a liner formed of foamed energy management material (e.g. adhesive, fasteners, etc.) may be used.

As previously mention, the strap(s) 106 also pass through an opening 116 in the inner liner 104. The strap 106 is not affixed to the inner liner 104 as it is to the outer liner 102, thus allowing for slight movement of the liners with respect to each other while reducing the risk of complete separation in the event of an impact. Anchoring the chinstraps 106 to the outer liner 102 while passing them through the inner liner 104 secures the two liners together without restricting their small relative movements in relation to each other.

In addition to providing stability to the helmet, coupling the chin straps 106 to the helmet 100 in this manner further provides a back-up safety feature. In the event that the elastomeric return springs fail and lose their connection between the inner 104 and outer 102 liners during an impact, the chin strap 106, which is clipped around the wearer's chin, is still connected to the outer liner 102 and extends through one or more openings in the one or more other liner(s). In this way, the cycling helmet 100 will be more likely to remain in place on the user's head rather than splitting into separate liners.

Figure 2:
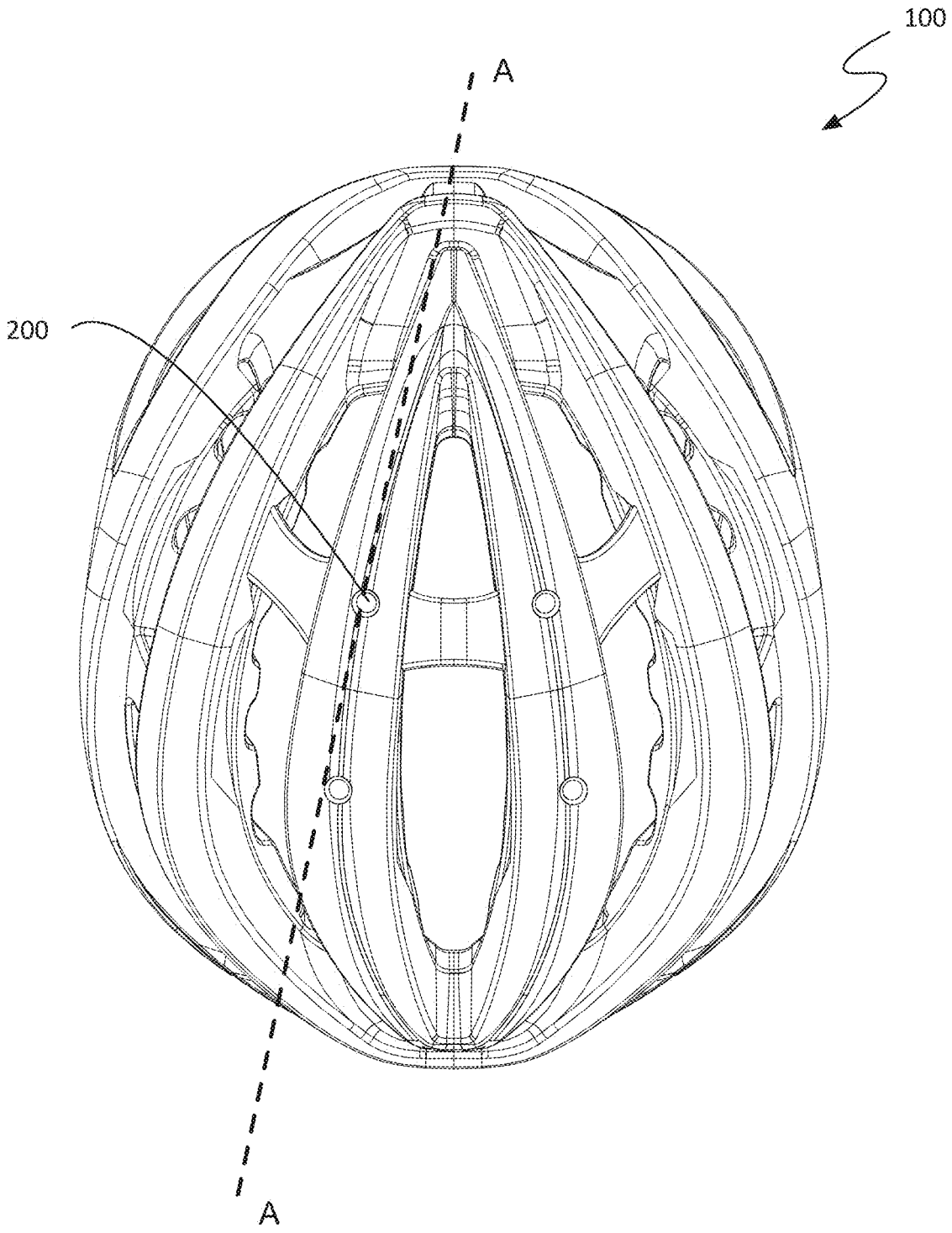
FIG. 2 is a top view of the helmet of FIG. 1.

FIG. 2 is a top view of the non-limiting example of a helmet 100 shown in FIGS. 1A and 1B. According to various embodiments, the helmet 100 may comprise one or more leash couplings 200 that join the outer liner 102 and inner liner 104 with a tether that provides an upper limit to the potential motion of the liners with respect to each other. The leash coupling 200 will be discussed in greater detail with respect to FIGS. 7A and 7B, below.

Figure 3:
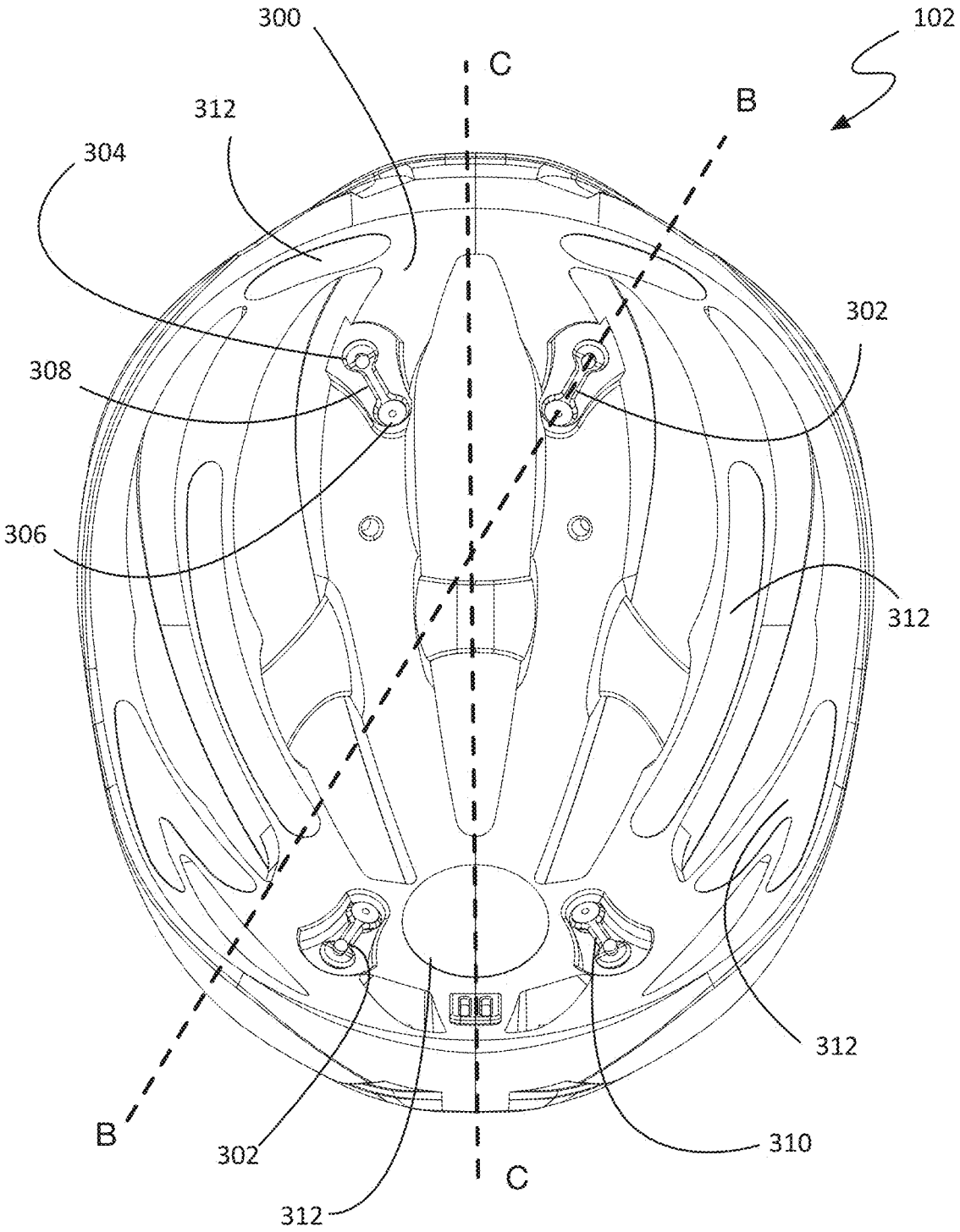
FIG. 3 is a bottom view of an outer liner.

FIG. 3 is a bottom view of the non-limiting example of an outer liner 102 shown in FIGS. 1A and 1B. As shown, the outer liner 102 has an inward-facing surface 300 on which a plurality of return springs 302 are coupled. According to various embodiments, the inward-facing surface 300 of the outer liner 102 may also comprise one or more glide pads 312. Glide pads will be discussed in greater detail with respect to FIG. 4B, below.

According to various embodiments, the outer liner 102 and the inner liner 104 are coupled to each other through the plurality of return springs 302, which serve to attenuate rotational energy from an impact by deforming as the liners rotate with respect to each other. The return springs 302 comprise an elastomeric material 310, able to be elastically deformed while biased toward its original shape. Examples include, but are not limited to, rubber, silicone, thermoplastic elastomers, and the like. The degree of elasticity and the range of motion provided by each return spring 302 may be modified by geometry as well as composition, as is known in the art.

As shown, each return spring 302 comprises a first end 304, a second end 306 distal to the first end 304, and a body 308 connecting the first end 304 to the second end 306. The first end 304 is coupled to the inward-facing surface 300 of the outer liner 102, and the second end 306 is coupled to the outward-facing surface 206 of the inner liner 104, according to various embodiments. The manner in which the return springs 302 are coupled to the liners will be discussed further with respect to FIG. 4A, below.

The return springs 302 permit the outer liner 102 to rotate with respect to the inner liner 104, but pulls them both back to the centered, neutral position, referred to as the first position. The return springs 302 may be made with a variety of sizes, shapes, and materials, giving them different ranges of motion and attenuation ability. When the liners rotate with respect to each other, the return springs 302 bias them back to the first position, as will be discussed with respect to FIGS. 6A and 6B, below.

In some embodiments, the helmet 100 may comprise four return springs 302, as shown in FIG. 3. In other embodiments, fewer return springs 302 may be used, while in still others, more springs may be used. Increasing the number of return springs 302 may provide more stability between the inner 104 and outer 102 liners, but may also increase the resistance against rotating the liners with respect to each other, potentially allowing more rotational energy to be transferred to the wearer in an impact.

Figure 4A:
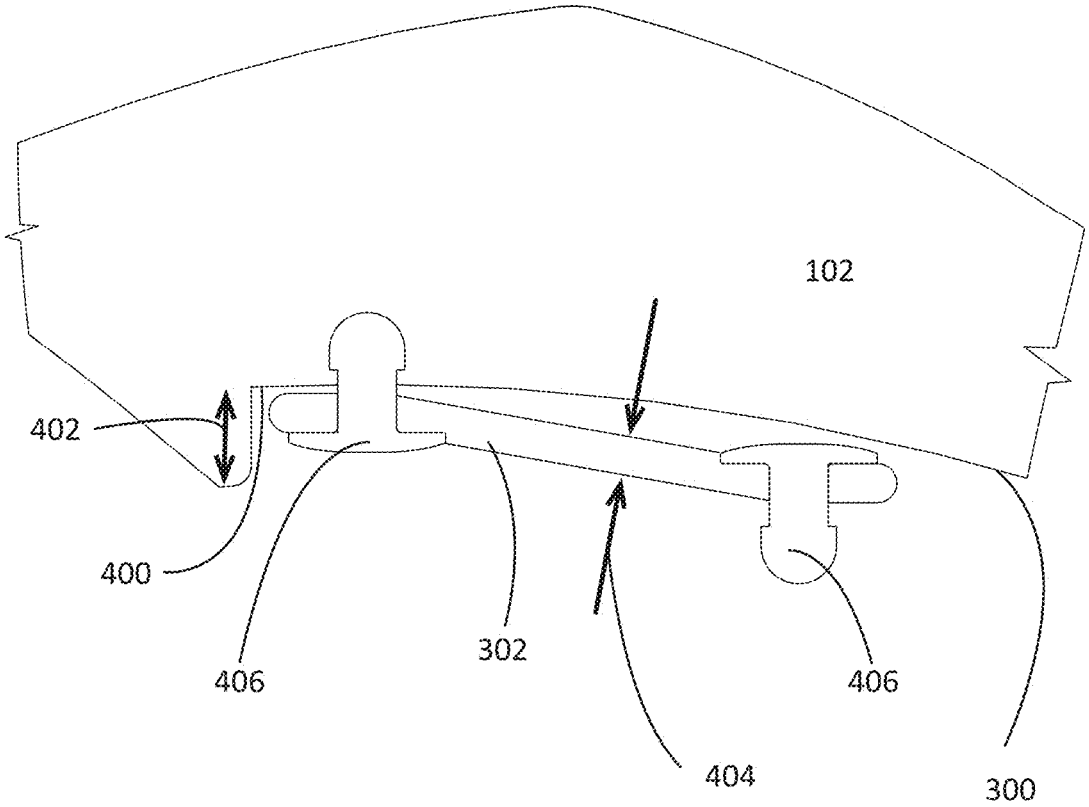
FIG. 4A is a cross-sectional view of a return spring taken along line B-B of FIG. 3.

FIG. 4A is a close-up cross-sectional view of a non-limiting example of a return spring 302 coupled to an outer liner 102, taken along line B-B of FIG. 3. According to various embodiments, return springs 302 may be seated within recesses in one of the liners. For example, as shown in FIGS. 3 and 4A, return springs 302 may be seated in a recess 400 in the outer liner 102. In other embodiments, the recesses 400 may be on the inner liner 104, while in still other embodiments, both the inner liner 104 and the outer liner 102 may have recesses 400 that align when the liners are coupled together.

As shown, in some embodiments, the recess 400 may have a depth 402 that is at least equal to the thickness 404 of the return spring 302 seated within it, thereby restricting the spring from overly inhibiting the relative rotation of the liners and transmitting impact energy to the wearer. In other embodiments, such as those where the return springs 302 sit in aligned recesses 400 in both liners, each recess 400 may have a depth 402 less than the thickness 404 of the return spring 302.

The use of recesses 400 may be advantageous, as they may facilitate the use of elongated return springs 302 that are substantially tangential to the interfacing surfaces of the liners (e.g. the outward-facing surface 114 of the inner liner 104 and the inward-facing surface 300 of the outer liner 102). In some embodiments, these interfacing surfaces may be substantially parallel to a portion of a sphere 408, or pseudo-sphere. As an option, the return springs 302 in such embodiments may be substantially tangential to said sphere or pseudo-sphere.

In the context of the present description and claims that follow, a return spring 302 is substantially tangential to a surface (e.g. liner surface, sphere, pseudo-sphere, etc.) when the angle formed between the body 308 of the return spring 302 (i.e. the direction of the body 308, on average, while the spring 302 is coupled to both liners) and the plane tangential to the surface at the point closest to the body 308 is no greater than 15 degrees. The use of recesses 400 and positioning the return springs 302 to be substantially tangential to the interfacing liner surfaces may be advantageous as it allows for the springs 302 to resist relative liner rotation in a greater number of directions without interfering with the rotation in a way that may mitigate some of the energy attenuation and injuring the wearer.

According to various embodiments, the first end 304 of a return spring 302 is coupled to the inward-facing surface 300 of the outer liner 102 and the second end 306 of the return spring 302 is coupled to the outward-facing surface 114 of the inner liner 104 when the helmet is fully assembled. In some embodiments, one of the ends of the return spring 302 may be in-molded into the foamed energy management material of a liner. As an option, the in-molded end may be shaped in a way to improve the grasp of the in-molding (e.g. increased surface area of a surface roughly parallel with the liner surface, etc.).

As shown, in some embodiments, one or both ends of the return spring 302 may be coupled to its respective liner through a fastener 406 that pins the end to the surface of the liner. For example, in some embodiments, the fastener 406 may be a pin that pierces the return spring end, while in other embodiments the return spring end may have an opening sized to receive part of the fastener, but not large enough to allow the fastener 406 to pass all the way through. As an option, the fasteners 406 may be barbed to better grip the material of the liner, or may feature a catch shaped to interface with a receiver, as will be discussed with respect to FIG. 5. Those skilled in the art will recognize that other types of fasteners may be employed in place of a pin.

The use of fasteners 406 operated by a linear motion, such as a pin, are advantageous as they allow for the outer liner 102 and inner liner 104 to be coupled to each other through the return springs 302 by coupling the springs to one of the liners, inserting said linearly-operated fasteners 406 in the free ends of the springs 302 such that they point away from the liner the spring is already attached to. The other liner is then lined up and pressed toward the other liner, until the fasteners 406 of the free ends have penetrated the second liner and the two liners are coupled together through the return springs 302. Those skilled in the art will recognize that linearly operated fasteners 302 are not limited to pins, but may also include adhesives, expanding nails, and the like.

Figure 4B:
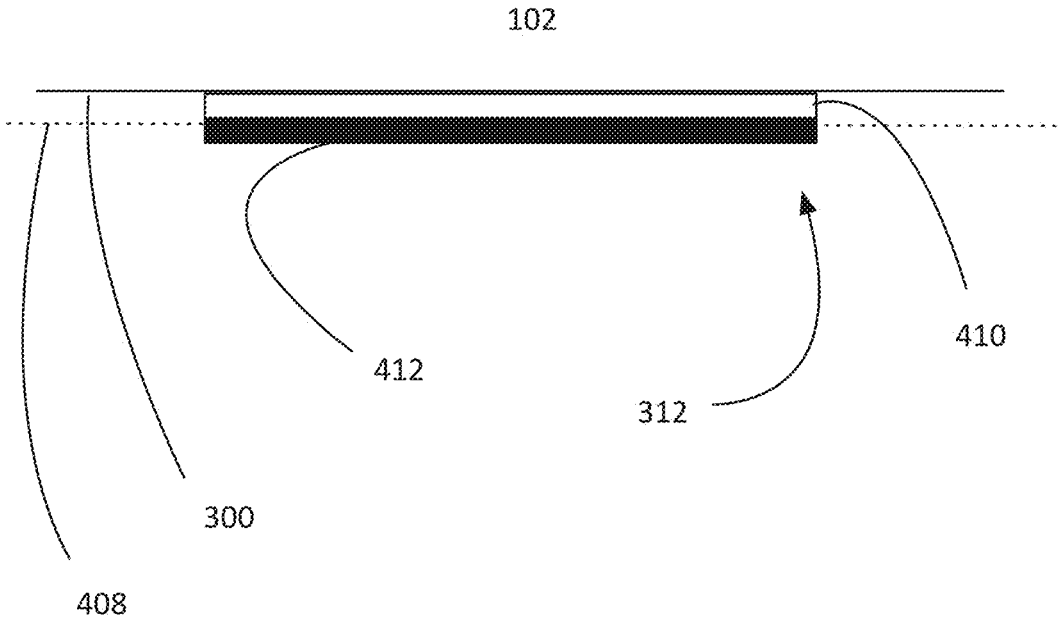
FIG. 4B is a cross-sectional view of a glide pad taken along line C-C of FIG. 3.

FIG. 4B is a close-up cross-sectional view of a non-limiting example of a glide pad 312 coupled to an outer liner 102, taken along line C-C of FIG. 3. Some embodiments of the helmet 100 may include one or more glide pads 312 placed as thin sheets of material having a glide surface 412 and an adhesive surface 410 opposite the glide surface 412 and affixed to one of the interfacing liner surfaces. According to various embodiments, the glide surface 412 has a coefficient of friction lower than the coefficient of friction of the interfacing liner surfaces. For example, in one embodiment, the glide surface 412 may comprise Teflon.

These glide pads 312 may be die-cut and then attached to sections of one or both interfacing surfaces where friction is most likely to occur. FIG. 4B shows a cross-section of a glide pad 312 attached to an outer liner 102. The glide pads 312 may serve to facilitate liner rotation as well as reduce squeaking during movement. They may also allow the liners to move easier in relation to each other by reducing the friction between the interfacing surfaces. In addition, the glide pads 312 may create a small gap between the inner 104 and outer 102 liners in all locations where there is not a glide pad 312. This may significantly reduce the surface area over which friction is generated, and therefore allow for easier rotation as well. Alternatively, the glide pads 312 may be formed as thicker portions that may be in-molded into the liner.

As previously mentioned, in some embodiments, the interfacing surfaces (i.e. the inward-facing surface 300 of the outer liner 102 and the outward-facing surface 114 of the inner liner 104) may be substantially parallel to a portion of a sphere 408, or a pseudo-sphere, or other curved surface. In the context of the present description and the claims that follow, substantially parallel means the angle between the normal of a point of one surface and the normal of the second surface at the point where the first normal intersects is no greater than 20 degrees. Shaping the liners such that the interface along a spherical or pseudo spherical surface (or portions of such a surface) may facilitate the relative rotation of the liners and improve the effectiveness of the helmet. It should be noted that while these interfacing surfaces may be substantially parallel to a sphere 408 or a pseudo-sphere, they are not limited to being solid surfaces, but may include voids. Helmets 100 typically have vents to improve the comfort of the wearer; said vents may create voids in the interfacing surfaces without inhibiting the rotation upon impact.

Figure 5:
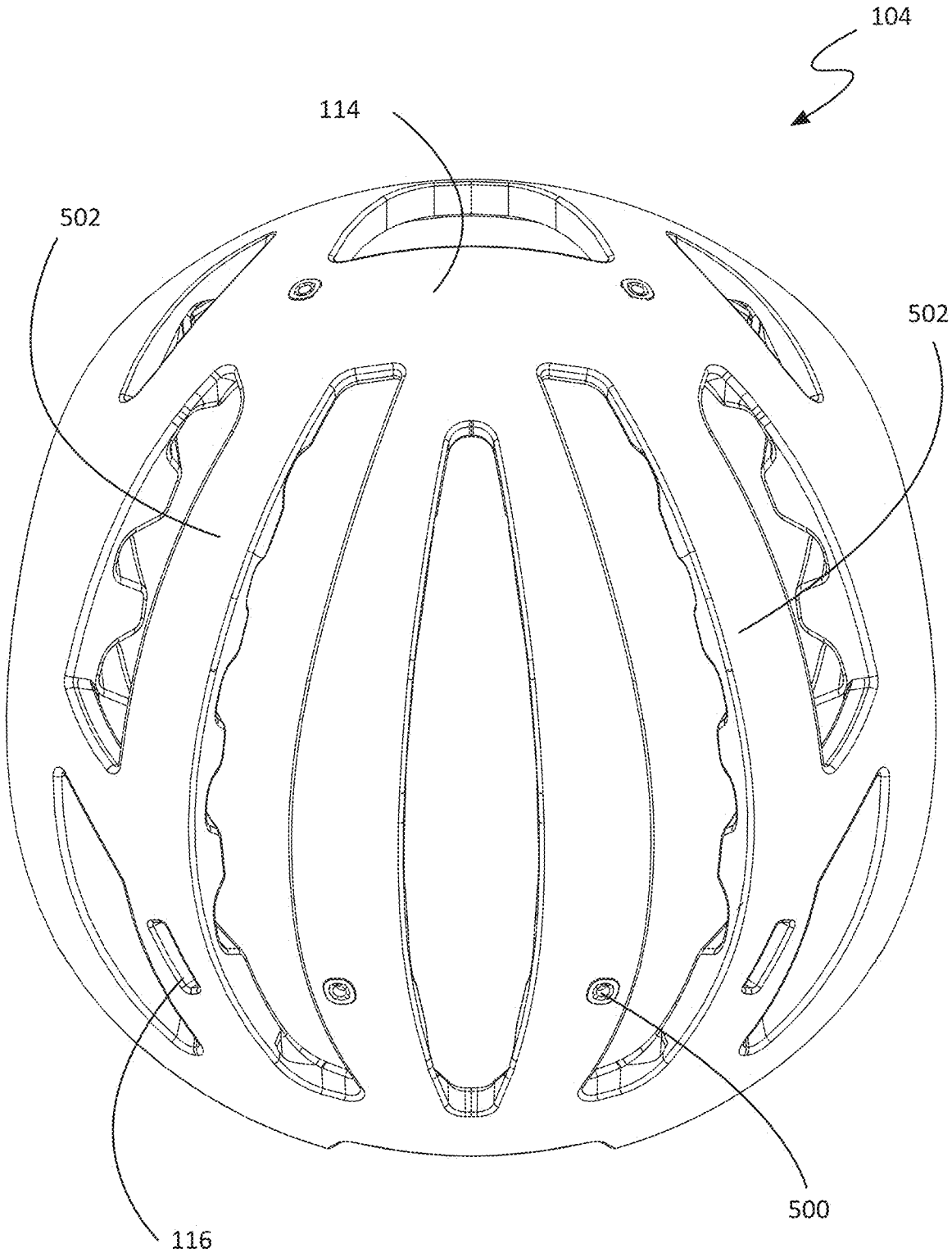
FIG. 5 is a top view of an inner liner.

FIG. 5 is a top view of a non-limiting example of an inner liner 104. As shown, outward-facing surface 114 of the inner liner 104 may comprise one or more prepared surfaces 502, according to various embodiments. A prepared surface 502 is a surface on either of the liners that has been modified to reduce friction and facilitate relative rotation. Unlike glide pads 312, prepared surfaces 502 do not employ the use of adhesive, but instead are either directly incorporated into the liner or allowed to freely move. In one embodiment, a prepared surface 502 may comprise a low-friction coating, which may be applied as a liquid and may remain a liquid or may solidify into a smooth surface. In another embodiment, the prepared surface 502 may be a layer of thermoplastic such as polycarbonate that has been in-molded into an interfacing surface of one or more liners. As an option, said thermoplastic may be coated with a lubricant. In still another embodiment, a prepared surface 502 may be formed by annealing a portion of an interfacing surface, meaning it is heated to near the melting point until the that portion of the surface relaxes into a smoother form.

As shown in FIG. 5, a liner may comprise a plurality of receivers 500. Some embodiments making use of fasteners 406 to couple the return springs 302 to one or more of the liners may also employ receivers 500, or premade receptacles configured to receive a fastener 406 but not to release it (i.e. the fastener is locked inside the receiver). The use of receivers 500 may be advantageous, as they may be in-molded to provide a strong coupling to the liner while also allowing a linear operation of the fastener 406, and may further facilitate the proper alignment of the two liners during assembly.

Figure 6A:
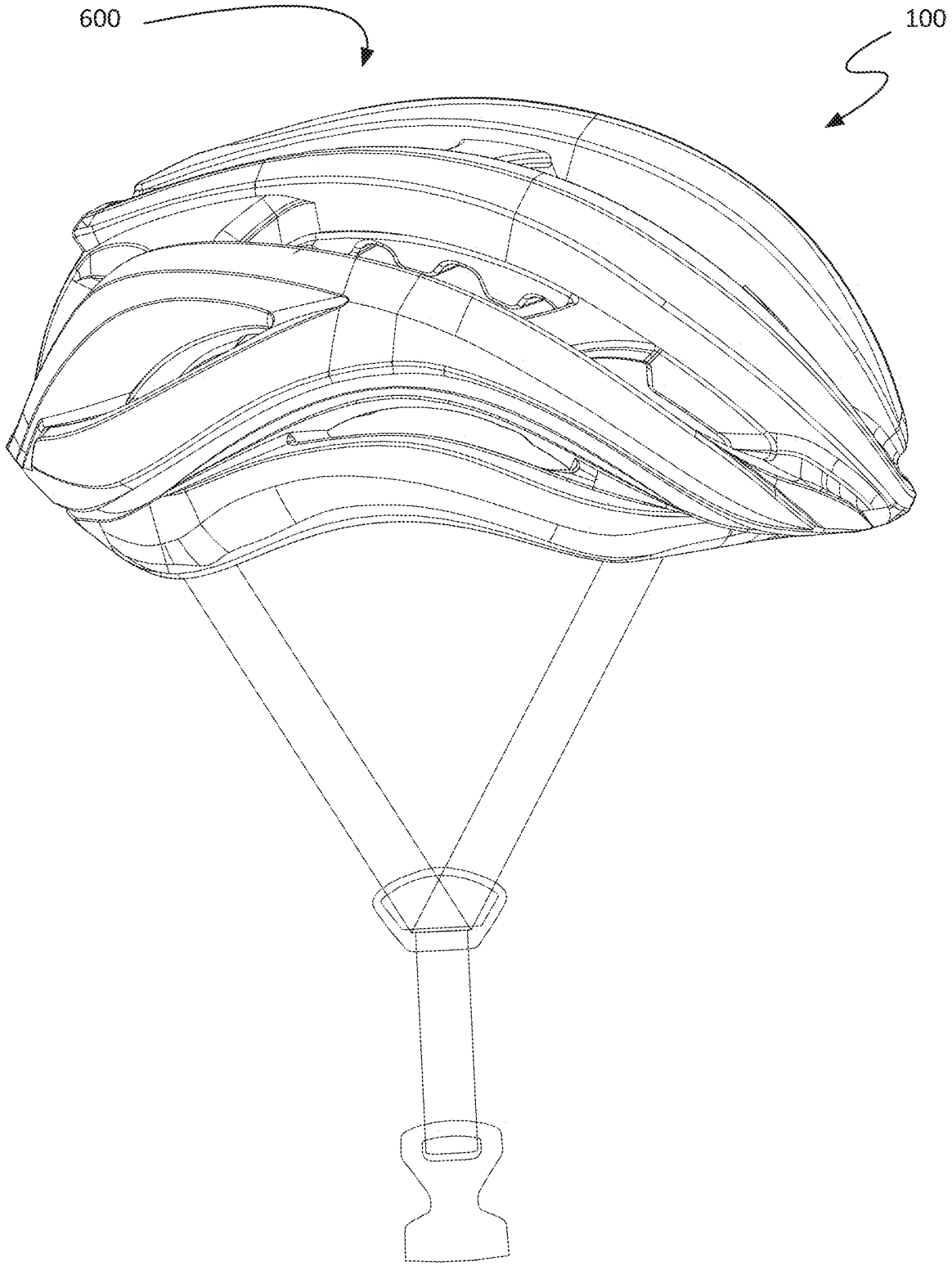
FIGS. 6A and 6B are side views of the helmet in a first position and a second position, respectively.
Figure 6B:
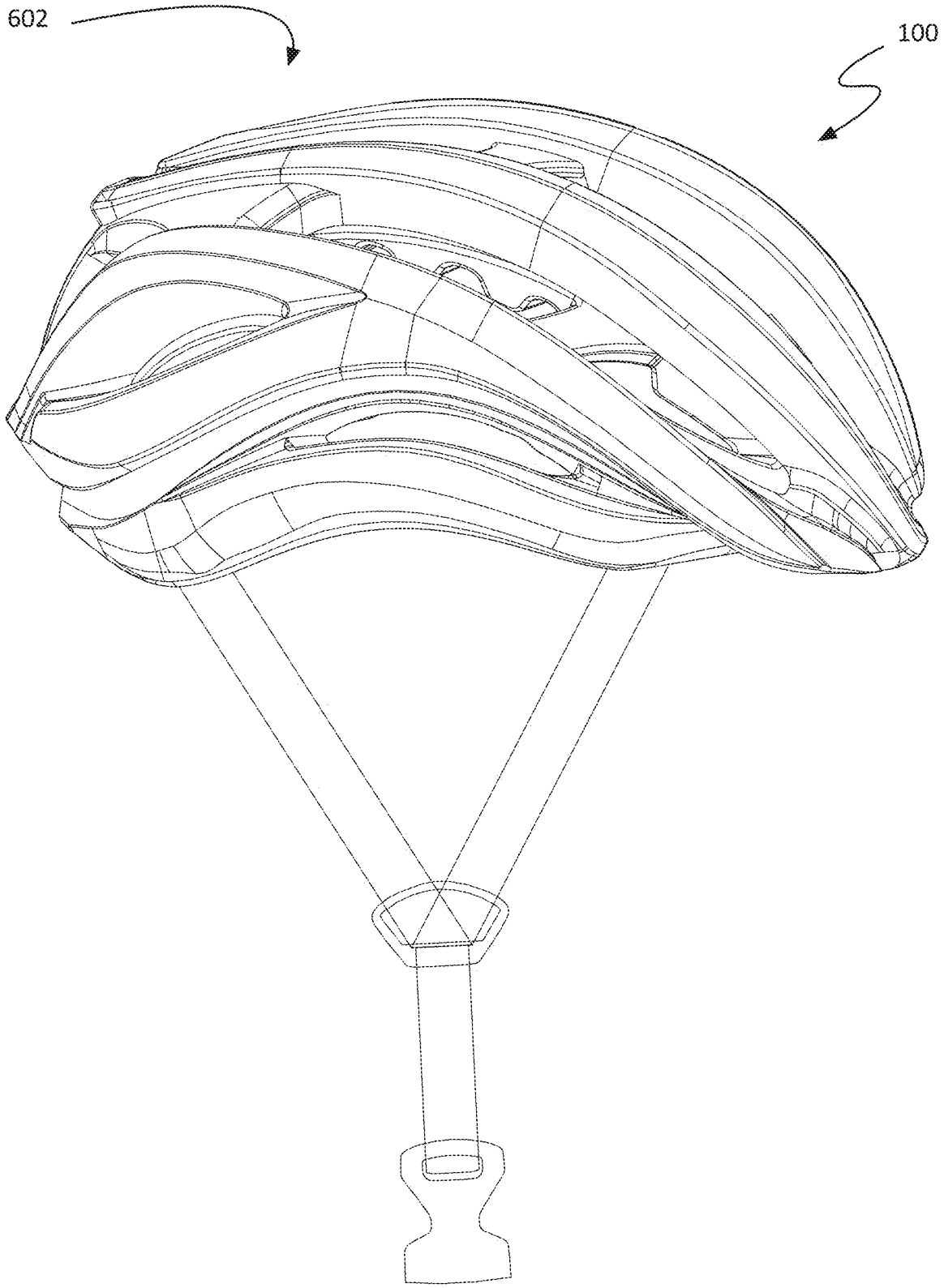

FIGS. 6A and 6B are side views of the helmet 100 in a first position 600 and a second position 602, respectively. The first position 600 is a neutral position, where the strain on all return springs 302 is at a minimum. This is the configuration the helmet 100 is biased towards when no other forces are operating on the liners. The second position 602 is a position where the inner liner 104 and the outer liner 102 are rotated with respect to each other away from the first position 600. Upon entering a second position 602, the bias of the return springs 302 will drive the liners back towards the first position 600. When an impact has imparted energy that is driving the liners from the first position 600 to a second position 602, some of that energy will be attenuated by the return springs 302 working to get back to the first position 600. The energy absorbed by the return springs 302 and the liners will result in a lessened blow experienced by the wearer.

While the use of elastomeric return springs to couple the outer and inner liners together is advantageous in attenuating rotational energy of an impact, they may become damaged or destroyed by forces experienced during an impact. The failure of the springs may result in the liners separating from each other during the impact, a time when they are needed the most. Accordingly, in some embodiments, the liners may be coupled to each other in a manner that allows their relative motion (and thus, impact attenuation), but limits that motion to a set range, reducing the risk of a complete separation of the two liners during or as a result of an impact event.

As previously mentioned, in some embodiments, the liners may be coupled to each other through one or more chin straps 106 that are affixed to the outer liner 102 and pass through an opening 116 in the inner liner 104. In some embodiments, the motion of a chin strap 106 through the inner liner 104 may be constrained to a particular range, such that the strap(s) may move through the inner liner 104 freely, to a point. For example, in one embodiment, the strap 106 may comprise a stopper that is unable to pass through the opening 116 in the inner liner 104, limiting the relative motion of the liners.

Figure 7A:
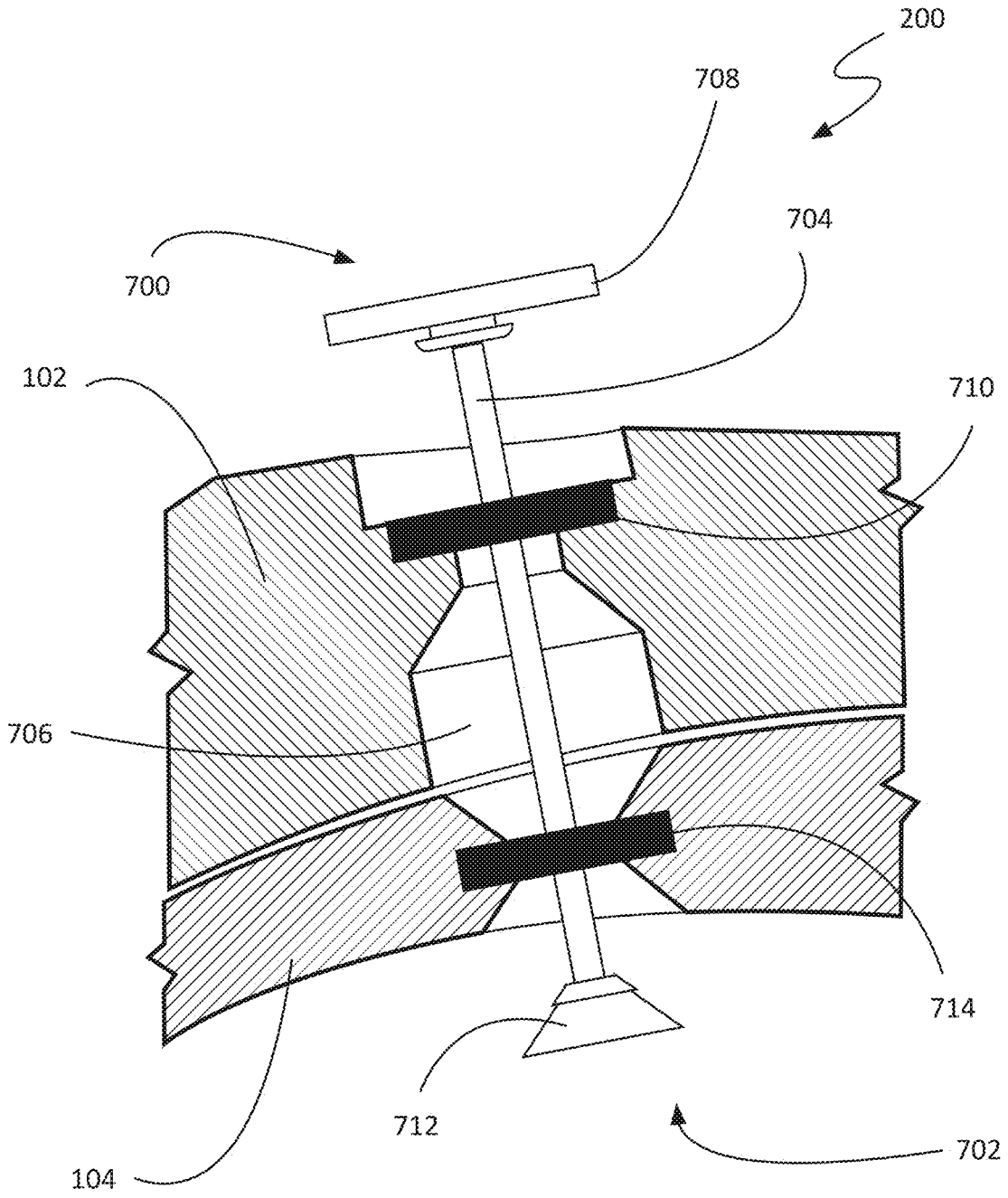
FIGS. 7A and 7B are a cross-sectional, exploded and assembled views of a leash taken along line A-A of FIG. 2, respectively.
Figure 7B:
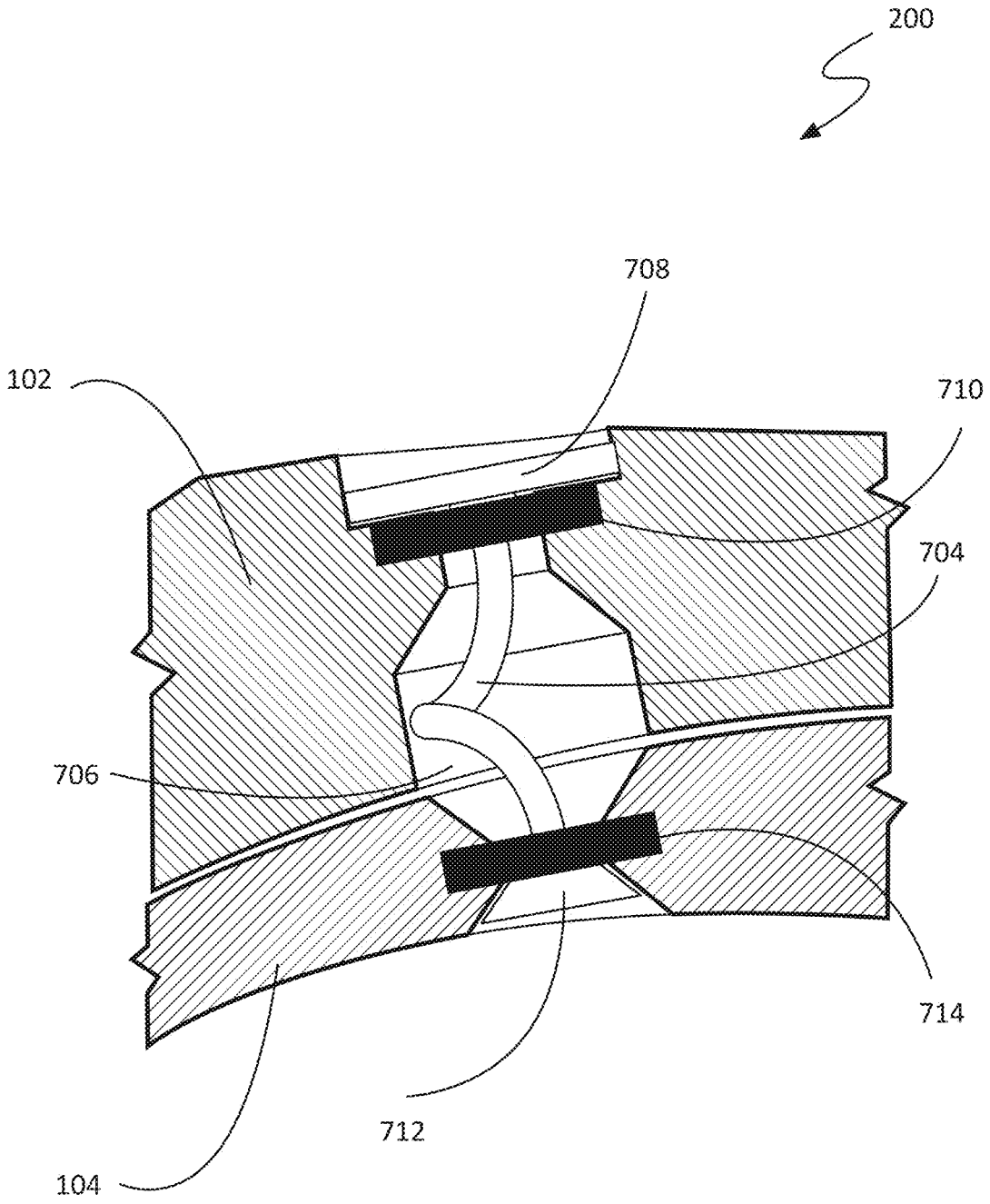

In some embodiments, the relative motion of the outer 102 and inner 104 liners of a helmet 100 may be limited by one or more leash couplings 200. FIGS. 7A and 7B show cross-sectional views of a non-limiting example of a leash coupling 200 along the line A-A of FIG. 2. Specifically, FIG. 7A is an exploded view, and FIG. 7B is an assembled view.

As shown, the leash coupling 200 comprises an upper end 700, a lower end 702 distal to the upper end 700, and a tether 704 that connects the upper 700 and lower 702 ends. The upper end 700 is coupled to the outer liner 102 and the lower end 702 is coupled to the inner liner 104.

The tether 704 passes through both of the outward-facing surface 114 of the inner liner 104 and the inward-facing surface 300 of the outer liner 102. In some embodiments, one or both of these surfaces may be formed with an aperture through which the tether 704 passes. In other embodiments, the tether 704 may be pierced through one or both of these surfaces during assembly of the helmet 100.

According to various embodiments, when the upper end 700 and lower end 702 of a leash coupling 200 are coupled to the outer 102 and inner 104 liners, respectively, there may be slack in the tether such that a range of relative movement between the liners is permitted without allowing them to completely decouple. Accordingly, the length of the tether 704 may be chosen such that the relative motion is constrained to a desired range. For example, in one embodiment, the length of the tether 704 may range between 10 mm and 15 mm. In another embodiment, the tether 704 may be between 8 mm and 17 mm long. In still another embodiment, a tether 704 of a leash coupling may be more than 15 mm. In some embodiments, the length of the tether 704 may be chosen such that the relative displacement between the liners is constrained to be within 10 mm to 15 mm, since the length of the tether 704 that provides such a limitation may depend on how and where it is coupled to the liners, and possibly the thickness of the liners, at least near the point of attachment. It should be noted that in some embodiments making use of chin straps 106 passing through the inner liner 104, the relative displacement or movement may also be constrained to be within 10 mm-15 mm.

As shown, in some embodiments, the tether 704, or at least a majority of the tether 704, may be located in a cavity 706 in one or both of the liners. The cavity 706 allows for excess slack in the tether 704 to be contained without interfering with the slipping movement of one liner with respect to another. In some embodiments, the cavity 706 may be formed in one or both of the liners. For example, as shown, in some embodiments, the cavity 706 may span both liners, being formed in both the outward-facing surface 114 of the inner liner 104 and the inward-facing surface 300 of the outer liner 102. In some embodiments, the cavity 706 may be formed during the molding of the liners, while in other embodiments it may be formed after the creation of the liners.

The upper end 700 is coupled to the outer liner 102 and the lower end 702 is coupled to the inner liner 104 in such as way that the coupling will be able to withstand forces that may otherwise compromise return springs, helping to maintain the protection provided by two liners throughout the impact event. In some embodiments, including the non-limiting example shown in FIGS. 7A and 7B, the leash coupling 200 may be attached to structures that are fixedly coupled to the liners. For example, in some embodiments, the upper end 700 of the leash coupling 200 may comprise an upper anchor 708, and the lower end 702 may comprise a lower anchor 712.

In the context of the present description and the claims that follow, an upper anchor and/or a lower anchor refers to a structure that may be coupled to a liner, either directly (e.g. in-molded, adhered, bonded, barbed and pierced, etc.) or by coupling with another structure that is already fixed coupled to the liner. For example, in the non-limiting example shown, the tether 704 passes through an upper snap receptacle 710 and a lower snap receptacle 714, both of which are fixedly attached to their respective liners (e.g. in-molded, bonded, adhered, etc.). The anchors "snap" into these receptacles, affixing the ends of the leash to the liners and limiting the relative motion.

In other embodiments, the anchors may couple with structures, such as these receptacles, only when the relative motion of the liners has reached it limit. For example, in one embodiment, the upper anchor 708 and lower anchor 712 may simply be larger than an aperture in the respective receptacles, such that the tether 704 may pass through, but not the anchors. When the relative displacement of the liners has reached its limit, the anchors will be in contact with (coupled to), but not passing through, the receptacles, causing the tether 704 to halt any further relative displacement.

In some embodiments, one or both anchors may be integral with the tether 704, while in other embodiments, one or both anchors may be coupled to the tether 704 after manufacture. According to various embodiments, the tether 704 is flexible, and may be composed of any material that is both strong and able to bend and allow the liners to move freely, within their constrained range of relative motion or displacement. Exemplary materials include, but are not limited to, nylon and other polymers, metal, natural fibers, and the like. The tether 704 may be a single strand, or may be composed of multiple strands (e.g. braided cable, twisted cable, etc.).

In some embodiments, a helmet 100 may have one or more leash couplings 200 connecting the outer liner 102 with the inner liner 104. For example, a helmet 100 may comprise 1, 2, 3, 4, 5, or more leash couplings 200, according to various embodiments. In some embodiments, a helmet 100 may make use of the chin strap 106 passing through the inner liner 104 while affixed to the outer liner 102, as previously discussed, in addition to making use of one or more leash couplings 200. In other embodiments, a helmet may make use of the chin straps 106 alone, or the leash couplings 200 alone. As an option, either or both methods of constraining the range of relative motion between liners may be used in helmets that do not make use of elastomeric return springs.

Figure 8:
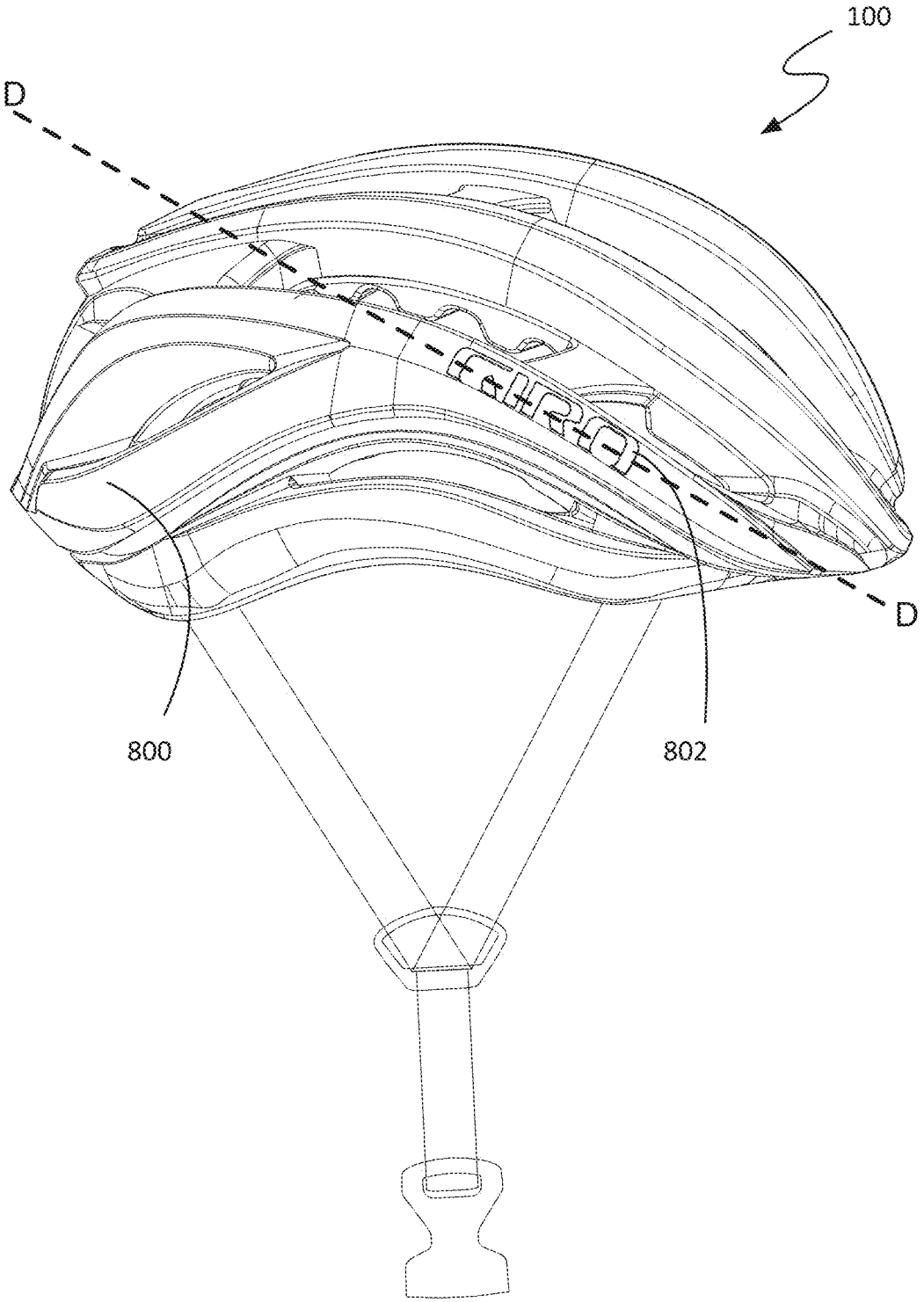
FIG. 8 is a side view of a branded helmet.
Figure 9:
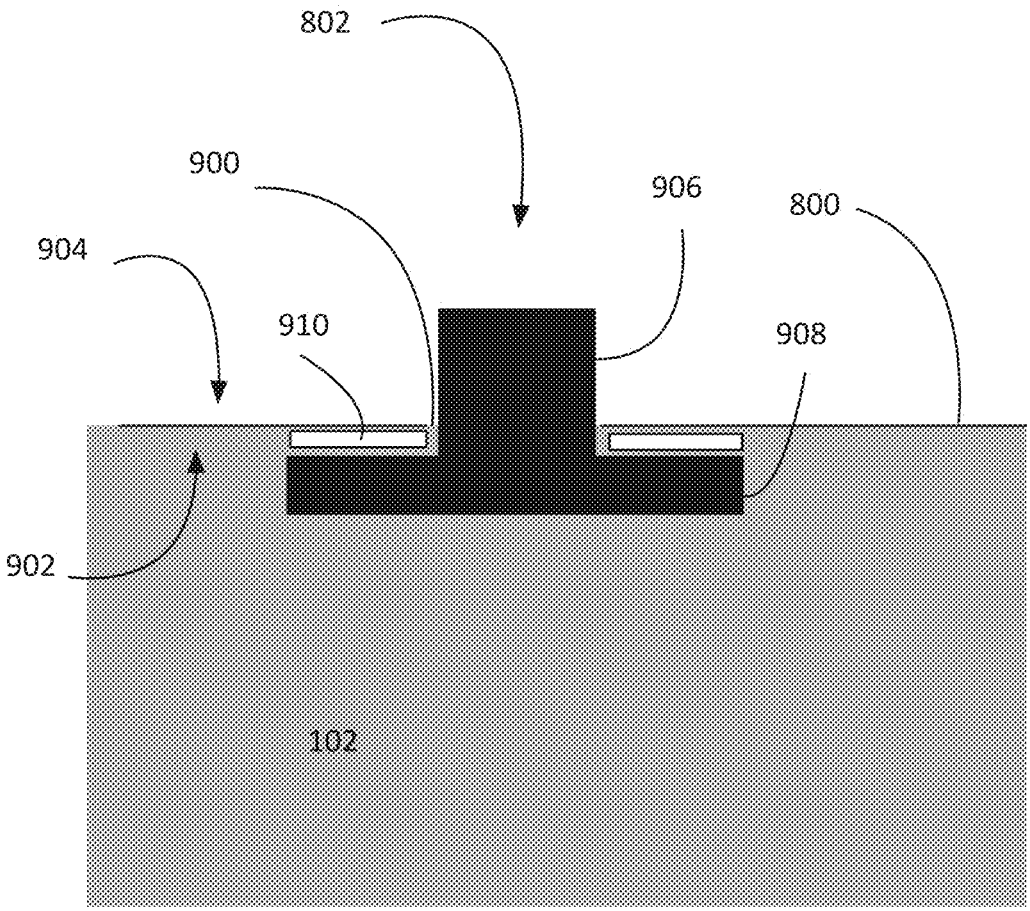
FIG. 9 is a cross-sectional view of a branding element taken along line D-D of FIG. 8.

Conventionally, lettering or other branding attached to a helmet is attached using a sticker, or by molding letters that are then adhesively coupled to an outer surface of the helmet. Over time, however, and through use, the branding tends to fall off. Contemplated herein is a method for branding a helmet such that the branding is durable without sacrificing clarity or ease of manufacture. FIG. 8 is a side view of a helmet 100 comprising a branding element 802 and an outer shell 800. FIG. 9 is a cross-sectional view of the branding element 802, outer shell 800, and outer liner 102 of the helmet 100 of FIG. 8, taken along the line D-D of FIG. 8. In the context of the present description and the claims that follow, a branding element 802 is a premade object that has a symbol, lettering, and/or logo that is part of the branding of a helmet, and further comprises connective structure coupling the different parts of the symbol/lettering/and/or logo into a single piece.

The outer shell 800 may be any thin shell that may be attached to the outward-facing surface 112 of the outer liner 102 through in-molding. As shown in FIG. 9, the outer shell has an inward-facing surface 902 and an outward-facing surface 904. The outer shell 800 further comprises a shaped aperture 900 configured to receive a first portion 906 of the branding element 802. The first portion 906 of the branding element 802 comprises the actual branding (e.g. symbols, letters, logos, etc.) that is meant to be visible on the assembled helmet 100. The second portion 908 of the branding element 802 is the remainder, including a surface from which the first portion extends outward. In some embodiments, the second portion 908 may be roughly planar, while in other embodiments it may be curved to match the shape of the portion of the outer liner on which it will rest.

In some embodiments, the shaped aperture 900 may be created in the outer shell 800 as part of the formation of the outer shell 800 (e.g. formed in a mold, etc.). In other embodiments, the shaped aperture 900 may be cut in the outer shell 800 after it has been formed. In one embodiment, the shaped aperture 900 is cut into the outer shell 800 using a laser cutter. Those skilled in the art will recognize other methods for creating the shaped aperture 900 in the outer shell 800.

The method for installing the branding element 802 is straightforward, and will not require a large deviation in the overall manufacturing process of the helmet 100. First, an adhesive 910 may be applied to the face of the second portion 908 of the branding element 802 from which the first portion 906 extends. As an option, the adhesive 910 may be pressure activated. Then, the branding element 802 is inserted through the back of the preformed outer shell 800, the first portion 906 passing through the shaped aperture 900. Pressing the branding element 802 against the outer shell causes the adhesive to bond the second portion 908 to the inward-facing surface 904 of the outer shell 800 proximate the branding element 802, while the first portion 906 of the branding element extends outward from the outward-facing surface 904 of the outer shell 800. The adhesive helps keep the branding element 802 in place. Next, the outer liner 102 is formed inside of the outer shell 800, in-molding it and thermally bonding it to the outer shell 800 and second portion 908, and possibly thermally bonding the outer shell 800 to the second portion 908 as well. Upon formation of the outer liner 102, the second portion 908 is trapped between the outer liner 102 and the outer shell 800.

In some embodiments, the branding element 802 may be thermally bonded to the outer shell 800 before formation of the outer liner 102. Once the outer shell 800 with the bonded branding element 802 is placed in a molding tool, a rubber insert containing a negative of the first portion 906 may be placed inside the first portion 906. This rubber insert helps to protect the branding during the molding process. In addition, the rubber insert exerts reverse pressure to the expansion of the foam during molding, thus helping the inner portions of the branding to seat correctly and the pressure sensitive adhesive to bond correctly. Once the molding process has finished, the helmet is complete and the branding has been inserted into the helmet 100 in a way that it is not likely to fall out or be removed without destroying the helmet, as opposed to conventional methods of attaching branding to a cycling helmet.

It should be noted that this method of attaching a branding element 802 to a helmet 100 may be adapted for use in the manufacture of helmets that to not make use of a foamed outer liner. For instance, in some embodiments, the second portion 908 may be trapped between an outer shell and another hard shell such as polycarbonate, or carbon fiber, or the like.

Figure 10:
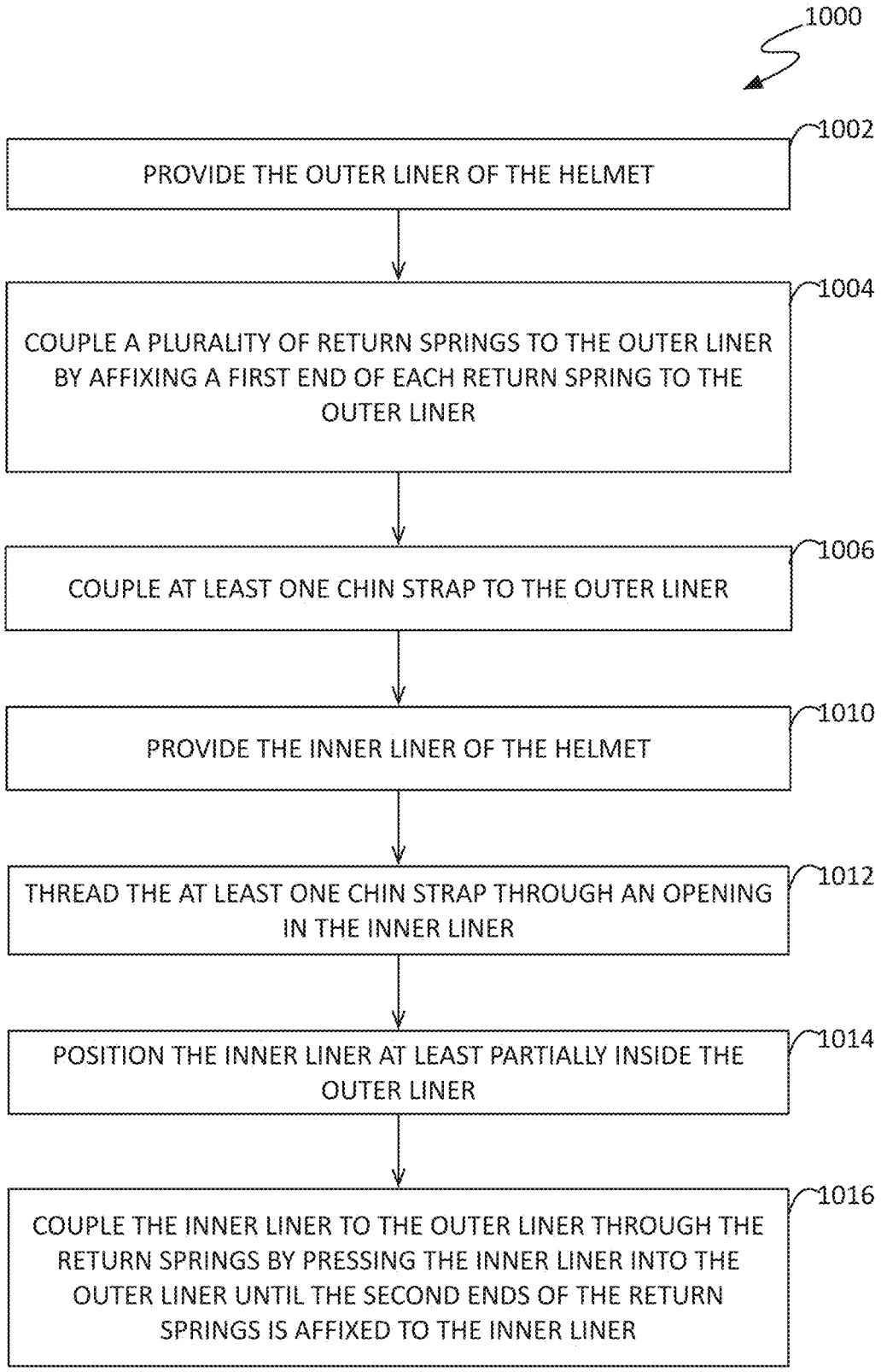
FIG. 10 is a process flow for assembling a helmet having an inner liner and an outer liner.

FIG. 10 is a process flow of a method 1000 for assembling a helmet 100 comprising an inner liner 104 and an outer liner 102, according to various embodiments. As shown, the method 1000 includes providing the outer liner 102 of the helmet 100, the outer liner 102 having an inward-facing surface 300. The method 1000 further includes coupling a plurality of return springs 302 to the outer liner 102 by affixing a first end 304 of each return spring 302 to the outer liner 102. Each return spring 302 comprises an elastomeric material 310 and further comprises a second end 306 distal to the first end 304 and having a different one of a plurality of fasteners 406, according to various embodiments.

Next, the method 1000 comprises coupling at least one chin strap 106 to the outer liner 102, and providing the inner liner 104 of the helmet 100. The inner liner 104 has an outward-facing surface 114.

Furthermore, the method 1000 includes positioning the inner liner 104 at least partially inside the outer liner 102, such that the inward-facing surface 300 of the outer liner 102 is facing the outward-facing surface 114 of the inner liner 104. The method 1000 includes threading the at least one chin strap 106 through an opening 116 in the inner liner 104. Finally, the method 1000 includes coupling the inner liner 104 to the outer liner 102 by pressing the inner liner 104 into the outer liner 102 until the plurality of fasteners 406 are passing through the outward-facing surface 114 of the inner liner 104, thereby coupling the outward-facing surface 114 to the inward-facing surface 300 through the plurality of return springs 302.

Where the above examples, embodiments and implementations reference examples, it should be understood by those of ordinary skill in the art that other helmets and manufacturing methods and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet assembly methods as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an outer liner comprising an inward-facing surface;

an inner liner comprising an outward-facing surface configured to interface with the inward-facing surface of the outer liner;

a plurality of return springs configured to bias the inner liner to a first position with respect to the outer liner, the outer liner configured to rotate with respect to the inner liner to a second position different from the first position upon an impact to the helmet, the plurality of return springs configured to attenuate a portion of energy imparted by the impact to move the inner liner toward the first position with respect to the outer liner; and a plurality of recesses in which the plurality of return springs is seated, the plurality of recesses being formed in either the outer liner or the inner liner but not both the outer liner and the inner liner.

2. The helmet of claim 1, further comprising:

a flexible tether configured to couple the outer liner to the inner liner.

3. The helmet of claim 2, further comprising:

a cavity formed in at least one of the outer liner and inner liner, wherein the flexible tether comprises a slack, the cavity configured to contain at least a portion of the slack.

4. The helmet of claim 1, further comprising:

at least one glide pad having an adhesive surface affixed to one of the inward-facing surface of the outer liner and the outward-facing surface of the inner liner; and a glide surface opposite the adhesive surface, the glide surface having a coefficient of friction lower than the coefficient of friction of the one of the inward-facing surface of the outer liner and the outward-facing surface of the inner liner.

5. The helmet of claim 1, wherein the outer liner is formed of a first foamed energy management material and the inner liner is formed of a second foamed energy management material.

6. The helmet of claim 1, further comprising:

a plurality of fasteners coupled to the plurality of return springs, each of the plurality of fasteners further coupled to the other of the outer liner or the inner liner that does not comprise the plurality of recesses.

7. The helmet of claim 6, wherein the outer liner comprises the plurality of recesses, and wherein the each of the plurality of fasteners is configured to couple to the inner liner.

8. The helmet of claim 1, further comprising:

an aperture formed in at least one of the outer liner and inner liner; and a branding element, the aperture configured to receive at least a portion of the branding element.

9. A helmet, comprising:

an outer liner comprising an inward-facing surface;

an inner liner comprising an outward-facing surface configured to interface with the inward-facing surface of the outer liner;

a plurality of return springs configured to bias the inner liner to a first position with respect to the outer liner, and the outer liner configured to rotate with respect to the inner liner to a second position different from the first position upon an impact to the helmet, the plurality of return springs configured to attenuate a portion of energy imparted by the impact to move the inner liner toward the first position with respect to the outer liner; and a flexible tether comprising a slack and configured to couple the outer liner to the inner liner.

10. The helmet of claim 9, further comprising:

a cavity formed in at least one of the outer liner and inner liner, wherein the flexible tether comprises a slack, the cavity configured to contain at least a portion of the slack.

11. The helmet of claim 9, further comprising:

at least one glide pad having an adhesive surface affixed to one of the inward-facing surface of the outer liner and the outward-facing surface of the inner liner; and a glide surface opposite the adhesive surface, the glide surface having a coefficient of friction lower than the coefficient of friction of the one of the inward-facing surface of the outer liner and the outward-facing surface of the inner liner.

12. The helmet of claim 9, wherein the plurality of return springs comprises four return springs.

13. The helmet of claim 9, further comprising:

a plurality of recesses in which the plurality of return springs is seated, the plurality of recesses being formed in either the outer liner or the inner liner.

14. The helmet of claim 13, further comprising:

a plurality of fasteners coupled to the plurality of return springs, wherein the plurality of fasteners is coupled to the other of the outer liner or the inner liner that does not comprise the plurality of recesses.

15. A helmet, comprising:

an outer liner comprising an inward-facing surface;

an inner liner comprising an outward-facing surface that interfaces with the inward-facing surface of the outer liner;

a return spring configured to bias the inner liner to a first position with respect to the outer liner, and the outer liner configured to rotate with respect to the inner liner to a second position different from the first position, the return spring coupled to one of the outer liner or the inner liner, the return spring configured to attenuate a portion of energy imparted by an impact to the helmet to move the inner liner toward the first position with respect to the outer liner; and a fastener coupled to the return spring and to either the outer liner or the inner liner, the fastener configured to extend at least partially outside of either the outer liner or the inner liner.

16. The helmet of claim 15, further comprising:

a flexible tether configured to couple the outer liner to the inner liner; and a cavity formed in at least one of the outer liner and inner liner, wherein the flexible tether comprises a slack, the cavity configured to contain at least a portion of the slack.

17. The helmet of claim 15, wherein the return spring is one of a plurality of return springs.

18. The helmet of claim 15, further comprising:

a recesses in which the return spring is seated, the recess being formed in either the outer liner or the inner liner, wherein the fastener is coupled to the other of the outer liner or the inner liner that does not comprise the recess.

19. The helmet of claim 15, further comprising:

an aperture formed in at least one of the outer liner and inner liner; and a branding element, the aperture configured to receive at least a portion of the branding element.

20. The helmet of claim 15, further comprising:

a receiver formed in either the outer liner or the inner liner and configured to receive the fastener.

* * * * *